US006932532B2

(12) United States Patent
Schwartzman et al.

(10) Patent No.: US 6,932,532 B2
(45) Date of Patent: Aug. 23, 2005

(54) LIQUID APPLICATOR VALVE

(75) Inventors: Gilbert Schwartzman, Mamaroneck, NY (US); Martin Fischer, Patterson, NY (US)

(73) Assignee: Dab-O-Matic Corporation, Mount Vemon, NY (US)

( * ) Notice: Subject to any disclaimer, the term of this patent is extended or adjusted under 35 U.S.C. 154(b) by 43 days.

(21) Appl. No.: 10/616,957

(22) Filed: Jul. 11, 2003

(65) Prior Publication Data

US 2005/0008422 A1 Jan. 13, 2005

(51) Int. Cl.[7] ..... A47L 13/30
(52) U.S. Cl. ..... 401/264; 401/263; 215/311
(58) Field of Search ..... 401/263, 264, 401/265, 266; 215/306, 310, 311, 315; 222/212, 213

(56) References Cited

U.S. PATENT DOCUMENTS

| | | | | |
|---|---|---|---|---|
| 775,411 A | | 11/1904 | Wheeler | |
| 2,083,156 A | * | 6/1937 | McCabe | 222/207 |
| 2,681,752 A | | 6/1954 | Jarrett et al. | |
| 2,921,324 A | * | 1/1960 | Gibbons | 401/263 |
| 2,996,750 A | | 8/1961 | Cholet | |
| 3,129,452 A | | 4/1964 | Schwartzman | |
| 3,242,928 A | | 3/1966 | Peters | |
| 3,256,551 A | * | 6/1966 | Schwartzman | 401/206 |
| 3,400,997 A | | 9/1968 | Schwartzman | |
| 3,606,088 A | | 9/1971 | Baltzer | |
| 3,640,631 A | | 2/1972 | Sotir | |
| 3,661,468 A | | 5/1972 | Schwartzman | |
| 4,693,623 A | | 9/1987 | Schwartzman | |
| 4,993,859 A | | 2/1991 | Assad et al. | |
| 5,120,148 A | | 6/1992 | Waters et al. | |
| 5,299,877 A | | 4/1994 | Birden | |
| 6,402,413 B1 | | 6/2002 | Schwartzman | |

* cited by examiner

*Primary Examiner*—David J. Walczak
(74) *Attorney, Agent, or Firm*—Clyde I. Coughenour

(57) ABSTRACT

A fluid applicator includes a coating implement, an elastic closure cap, and a stopper for use with a fluid container. The elastic closure cap includes an enlarged irregular sealing rib on a skirt that is force-fit into the stopper, creating a resilient force on a sealing lip that contacts a seat on the stopper. Inverting the container and pressing on the coating implement, presses the elastic closure cap, deforming it to move the sealing lip off of its seat on the stopper to allow fluid flow from the container, through the stopper and elastic closure cap, to the coating implement.

20 Claims, 1 Drawing Sheet

LIQUID APPLICATOR VALVE

BACKGROUND OF THE INVENTION

1. Field of the Invention

A liquid valve body for attachment with the neck of a liquid container has liquid dispensed by inverting the container and pressing on an implement, such as one having tines, that in turn presses on an elastic closure cap having a valve seal that is lifted off of its seat on a stopper to pass liquid therethrough.

2. Description of Related Art

The dispensing of fluids by application of pressure against the coating or writing implement is common in the art. This application is a modification of the "Liquid Applicator Valve" of Gilbert Schwartzman, U.S. Pat. No. 6,402,413, issued 11 Jun. 2002, incorporated herein by reference. G. Schwartzman, U.S. Pat. No. 3,129,452, teaches a pressure opened valve held closed using a compressible material under the coating surface with the coating surface held in place over the compressible material by placement of the outer perimeter of the coating surface within a surrounding groove and crimping or swagging it in the groove to clamp it there. Waters et al, U.S. Pat. No. 5,120,148, issued 9 Jun. 1992, teaches a resilient cap that biases a valve against a valve seat. The resilient cap is provided with a rib around its lower end, that is used to hold the cap in position, and dispensing holes in its upper end used as a dauber.

SUMMARY OF THE INVENTION

The invention is to an instrument for the application of a fluid for coating or treating by dispensing fluid from a container. The instrument consists of a stopper and an elastic closure cap. The elastic closure cap is one integral piece that essentially consists of a diaphragm and an elastic dome, that acts as a spring, and a valve neck with a sealing rib that engages with a valve seat on the stopper to form a fluid flow control.

The elastic closure cap is attached to, or inserted into, an annular recess in the stopper so that a force is created on the dome area of the elastic closure cap pressing the sealing rib against the stopper valve seat precluding fluid flow through the instrument or pressing the sealing rib away from the valve seat. Fluid is dispensed by pressing against the nib or other implement that in turn presses against the valve neck and lifts the sealing rib off of the valve seat to provide a flow path between the fluid container and the nib. The implement can include tines that rub or scrape and coat a surface.

DESCRIPTION OF THE PREFERRED EMBODIMENTS

Figure 1:
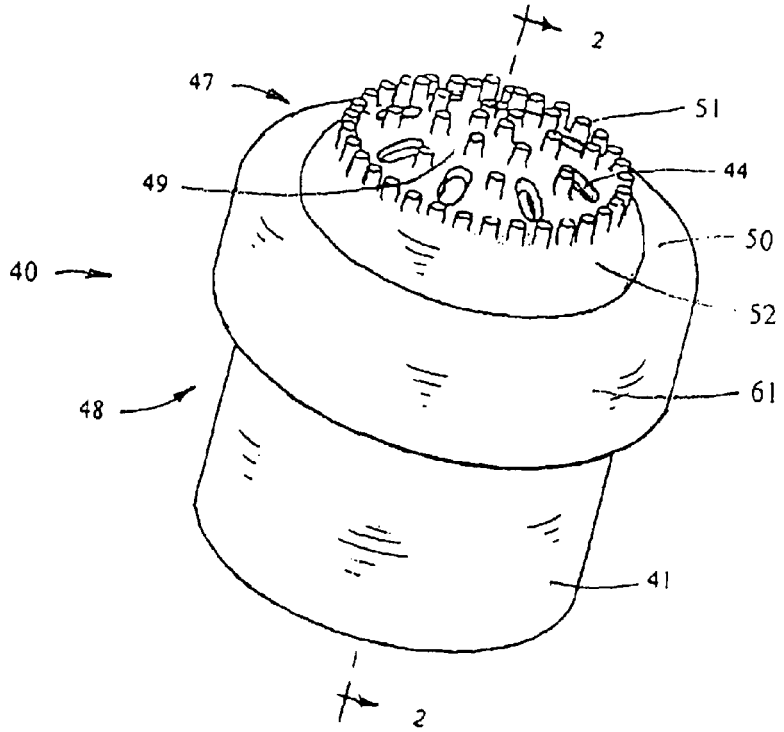
FIG. 1 is a perspective view of the applicator valve of the invention.

The invention is to an applicator 40. The major components shown in FIG. 1 are a stopper 48 and an elastic closure cap 47, that attach to a fluid container (not shown). The stopper 48 fits within or over a container neck to act as a seal against unwanted fluid discharge and as a controlled passage for fluid discharge. The stopper 48 supports the elastic closure cap 47 and the closure cap secures an implement, such as on having tines 51, in place. Pressure on the tines and/or diaphragm 49 portion of the elastic closure cap opens a fluid flow passage so that the fluid can pass from the fluid container to the elastic closure cap 47 and through the slot openings 44 to an object.

Figure 2:
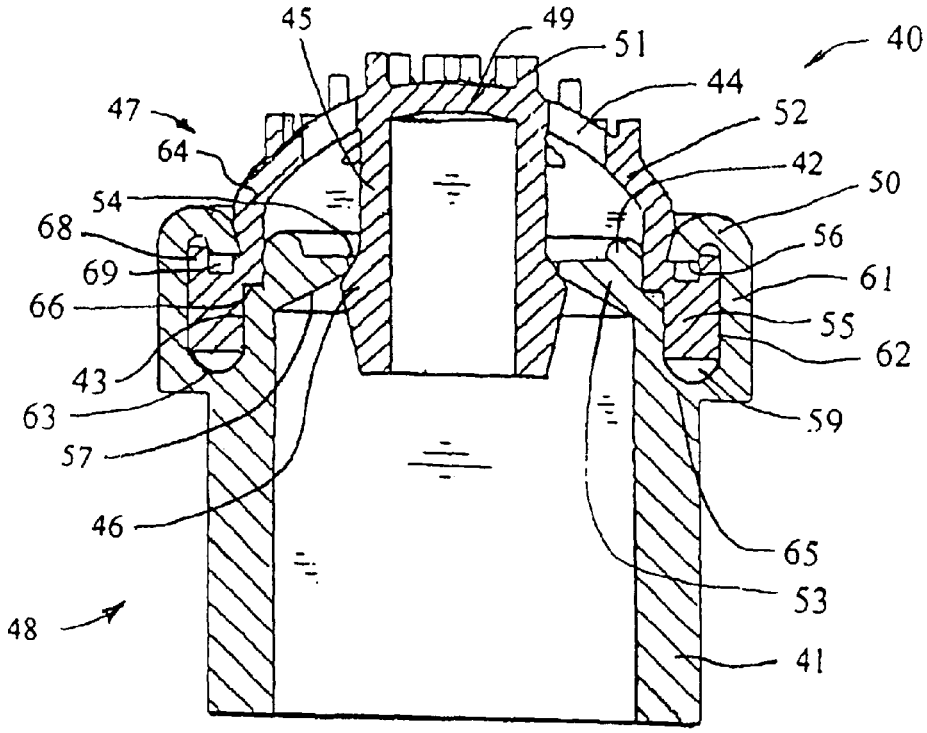
FIG. 2 is a sectional view of the application valve taken along the section line 2—2 of FIG. 1.

The individual components and interrelationships are best seen in FIG. 2. The stopper 48 second or lower end 41, as shown, is designed to fit within the upper neck of a fluid container by inserting the stopper lower neck 41 into the container neck or opening. The stopper second or lower end could be designed to fit over a container neck or both over and within the container neck if desired.

The first upper end 65 of the stopper 48 has a raised upwardly extending interior section 53 formed about a central opening 54. The lower wall of the stopper interior section 53 is sloped inwardly and upwardly forming a tapered valve seat 57 that ends or terminates in the central opening 54 fluid passage. The upper first end of the interior section 53 is provided with a raised circular limit rib 42. The outer wall of the interior section forms a sealing rim 43 that terminates at its lower end in a recessed base 63. Extending essentially parallel to and outwardly from the sealing rim 43 is an outer circumferential side wall 62 of the stopper that terminates, slightly above the circular limit rib 42, with an inwardly extending side wall 50.

The elastic closure cap 47 has an integral central diaphragm area 49 extending outwardly into a dome-shaped intermediate area section 52 with a skirt area 64 extending downwardly from the lower radial extremity of the intermediate dome area 52 forming a first end. A flexible or resilient implement, such as coating or scraping tines 51 extend upwardly from the diaphragm upper area 49 extremity. The dome area is provided with slot openings 44 inwardly of and adjacent to the intermediate area 52. About the center of the diaphragm area, a valve neck 45 extends downwardly from the diaphragm. At the lower end of the valve neck, a circular sealing lip 46 extends outwardly. The valve neck 45 is preferably hollow to reduce rigidity. The inner lower first end of the skirt area 64 is provided with a sealing enlargement or rib 55. The sealing rib enables a firm securement of the closure cap on the stopper so that the tines can be used to rub a surface with a coating material and/or to remove incidental material on a surface.

The elastic closure cap 47 can be made from an elastic resilient stretchable material such as a plastic or natural or synthetic rubber material having the necessary elasticity or resilience to flex or extend for insertion into or over the stopper 48, and to deform or stretch enough for sealing and valve operation, and to hold the implement. The material must be compatible with the fluid used. The tines can be strong enough to scrape a surface if desired. The diaphragm slot opening 44 performs two functions, it weakens the resistance to deformation of the central area of the diaphragm 49 and it provides a passage for the fluid moving past the sealing lip 46 when the valve neck is pressed inwardly.

The components are assembled by placing the stopper 48 neck 41 within a fluid container. The elastic closure cap 47 skirt 64 has a slightly larger diameter than that of the circumferential side wall 61 inside diameter, and the valve neck 45 has a smaller outside diameter than that of the diameter of the fluid passage 54 in the valve seat 57. The outside diameter of the sealing lip 46 is larger than that of the fluid passage 54. The skirt area 64 and sealing rib 55 can be pressed into the circumferential recess, between the side wall 62 and sealing rim 43 as the sealing lip 46 is pressed through the fluid passage in the tapered valve seat 57 until the elastic cap sealing rib 55 base or first end approaches the recess base 63 leaving a small void area 59. Pressing the elastic closure cap skirt 64 into the circumferential recess between the circumferential side wall 61 and sealing rim 43 places the dome area 49 under the compression, tending to press or deform the attached diaphragm and dome primarily upwardly. This upward movement of the dome area places an upward tension force on the central area of the diaphragm 49 and valve neck 45, attached to the diaphragm, and on the sealing lip 46 on the valve neck. This deformation or upward force causes a spring-like force on the valve neck 45 and sealing lip 46, preventing fluid flow by engaging the sealing lip with the stopper valve seat 57.

During non-use, the fluid within a fluid container is sealed therein by the sealing lip 46 of the elastic closure cap 47 pressing against the tapered valve seat 57. The fluid within the container can be dispensed to the implement by holding the container in the inverted position and pressing the implement against a surface or object. Upward and inward pressure on the inverted implement is transferred to the diaphragm area 49 where it acts against the now downward force created by the dome area 52 of the elastic cap 47. Overcoming the diaphragm resistance results in an inward movement of the valve neck 45 and sealing lip 46. The inward movement of the sealing lip causes it to separate from the tapered valve seat and to open a passage from the fluid container to the implement base or back through the fluid passage 54 and slot openings 44. The limit rib 42 of the stopper functions both as a guide for fluid flow, during fluid discharge, and to a degree as a limit stop for inward movement of the valve neck 45 and sealing lip 46. The limit rib 42 helps prevent the slots 44 of the elastic closure cap from being blocked by the upper end of the interior section 53 during pressure application against the times 51 and diaphragm 49. The limit rib can have its height and position, with respect to the opening or passage, adjusted depending on the rigidity and elasticity of the elastic closure cap, the flow path desired, the viscosity of the liquid or fluid being used, the valve opening desired, etc.

The lower end of the skirt 64 is offset forming a shoulder 66 and an annular recess inwardly of the sealing rib 55. The upper outer end of the sealing rib 55 extends upwardly into an annular projection 68 forming an outer recess 69.

The times 51 can be used as both liquid applicator and rubbing member. They can scrape a surface or a coating on a surface to be acted on in concert with a material dispensed onto the surface. It is preferred to firmly secure the elastic closure cap to the stopper. To do this, in addition to the resilient frictional forces that can be used between the stopper and elastic closure cap skirt, the stopper upper circumferential projection 61 is crimped or swagged inwardly and downwardly 50 into the outer recess 69 in the sealing rib 55. The terminal end 56 of the stopper upper end 50 is positioned within the outer recess 69. This results in the sealing rib 55 being thicker than the space remaining between the stopper extended interior sections and stopper first upper end 50. The terminal end 56 of the circumferential projection can be pressed against the closure skirt 64 with some indentation into it, and can press the dome inwardly reducing the outer circumference of the elastic cap at that area of the skirt 64.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

What is claimed is:

1. A fluid applicator valve comprising:

a stopper and an elastic closure cap;

said stopper having a first end and a second end, a fluid passage within said first end, a vertically opening circumferential recess within said first end outward from and around said fluid passage, a valve seat under and adjacent to said fluid passage;

said elastic closure cap having a first end and a second end, a skirt area on said first end, a dome area attached to and around said skirt area, a diaphragm area adjacent to and attached to said dome area on said second end central area, and a sealing lip attached to said diaphragm and extending toward said elastic closure cap first end;

said elastic closure cap skirt having an outwardly extending sealing rib fitting within said stopper vertically opening circumferential recess; and, said elastic closure cap dome area and diaphragm extending over said stopper first end and said fluid passage, and said sealing lip extending under said stopper fluid passage in said stopper second end side of said fluid passage;

said stopper vertically opening circumferential recess is formed by a circumferential side wall;

said circumferential side wall terminates by extending inwardly above said outwardly extending sealing rib to lock said elastic closure cap to said stopper, enabling said elastic closure cap to be pressed against and frictionally rubbed on a surface to be treated.

2. A fluid applicator valve as in claim 1 wherein said stopper vertically opening circumferential recess has an outside diameter that is slightly smaller than said elastic closure cap skirt outside diameter so that a compressive force is placed on said elastic closure cap dome when said skirt is inserted within said stopper vertically opening circumferential recess to place a force on said sealing lip tending to engage said elastic closure cap sealing lip with said stopper valve seat.

3. A fluid applicator valve as in claim 2 wherein:

said stopper first end has a circular limit rib for contact with said elastic closure cap to limit the distance said elastic closure cap can move toward said stopper fluid passage.

4. A fluid applicator valve as in claim 2 wherein:

said stopper first end vertically opening circumferential recess is formed between said circumferential side wall and an outer sealing rim of an interior section of said stopper;

said outer sealing rim has an annular recess;

said elastic closure cap has a resilient closure shoulder.

5. A fluid applicator valve as in claim 4 wherein:

said stopper has a sealing rim;

said elastic closure cap skirt has a shoulder outwardly offset from said elastic skirt to assist securement of said sealing rib.

6. A fluid applicator valve as in claim 1 wherein:

said elastic closure cap sealing lip is attached to said diaphragm area by a valve neck that is attached to and between said elastic closure cap diaphragm and said sealing lip;

said valve neck extends through said stopper fluid passage.

7. A fluid applicator valve as in claim 6 wherein:

said elastic closure cap skirt, dome area, diaphragm, valve neck, and sealing lip are all formed of a one-piece integral elastomeric material.

8. A fluid applicator valve as in claim 6 wherein:

said elastic closure cap valve neck as a diameter that is smaller than the diameter of said stopper fluid passage and said sealing lip outside diameter is larger than the diameter of said stopper fluid passage.

9. A fluid applicator valve as in claim 1 wherein:

said elastic closure cap dome and diaphragm area upper surface areas have a plurality of tines extending outwardly therefrom.

10. A fluid applicator valve as in claim 9 wherein:

said tines form multiple rubbing and coating protrusions from said elastic closure cap.

11. A fluid applicator valve as in claim 1 wherein:

said elastic closure cap dome has slot openings therein for the passage of fluid.

12. A fluid applicator valve as in claim 1 wherein:

said elastic closure cap dome and diaphragm area upper surface areas have a plurality of tines extending outwardly therefrom;

slot openings in said elastic closure cap dome between said tines allow passage of fluid between said plurality of tines.

13. A fluid applicator valve as in claim 1 wherein:

said elastic closure cap skirt extends outwardly, forming a shoulder, and downwardly forming said enlarged sealing rib;

an annular projection extends upwardly from said enlarged sealing rib outer upper surface forming an outer upwardly opening recess;

said stopper circumferential side wall terminates by extending inwardly locking said elastic closure cap to said stopper by extending into said outer upwardly opening recess.

14. A fluid applicator valve as in claim 13 including:

said stopper outer sealing rim having an annular recess for securing said elastic closure cap to said stopper;

said elastic closure cap dome and diaphragm area upper surface areas have a plurality of tines extending outwardly therefrom;

said tines being resilient for rubbing and coating a surface.

15. A fluid applicator valve comprising:

a stopper and an elastic closure cap;

said stopper having an outer circumference, a fluid passage within said circumference and a valve seat under and around said fluid passage;

said elastic closure cap consisting essentially of an integral diaphragm, dome, skirt and a sealing lip, with said dome extending around and blending into said diaphragm, and said skirt extending around and blending into and downwardly from said dome, and said sealing lip extending downwardly from said diaphragm and under said stopper fluid passage;

means for applying a force against said diaphragm for raising said sealing lip against said stopper valve seat;

means on said stopper for securing said elastic closure cap skirt;

said elastic closure cap skirt having an outwardly extending enlarged sealing rib;

said stopper outer circumference upper end extending inwardly above said enlarged sealing rib securing it to said stopper;

said means for applying a force on said sealing lip includes a difference between the circumferential length of said elastic closure cap skirt and said means for securing said elastic closure cap skirt to said stopper.

16. A fluid applicator valve as in claim 15 including:

openings in said elastic closure cap diaphragm for discharging fluid;

tines on said diaphragm outer surface for spreading fluid and for engaging a surface.

17. A fluid applicator valve as in claim 16 wherein:

said openings in said elastic closure cap are located to discharge fluid in-between said tines.

18. A fluid applicator valve as in claim 16 including:

an annular projection extending from said elastic closure cap enlarged sealing rib outer upper surface forming an outer upwardly opening recess;

said stopper outer circumference upper end extending into said sealing rib outer upwardly opening recess.

19. A fluid applicator valve as in claim 18 including:

said stopper having an inner upper surface around said fluid passage;

a circular limit rib for contact with said elastic closure cap to limit the distance said elastic cap can move toward said stopper fluid passage.

20. A fluid applicator valve as in claim 18 wherein:

said stopper outer circumference upper end is crimped into said elastic closure cap skirt to press it against an inner wall of said stopper.

* * * * *